US007814685B1

(12) United States Patent
Tankson

(10) Patent No.: US 7,814,685 B1
(45) Date of Patent: Oct. 19, 2010

(54) SHOE HEEL COVER

(76) Inventor: Vincent E. Tankson, 950 N. Karlov Ave., Chicago, IL (US) 60651

( * ) Notice: Subject to any disclaimer, the term of this patent is extended or adjusted under 35 U.S.C. 154(b) by 925 days.

(21) Appl. No.: 11/638,182

(22) Filed: Dec. 13, 2006

(51) Int. Cl.
*A43B 13/22* (2006.01)

(52) U.S. Cl. ..... 36/72 B

(58) Field of Classification Search ..... 36/72 B, 36/72 R
See application file for complete search history.

(56) References Cited

U.S. PATENT DOCUMENTS 1,528,254 A * 3/1925 McConnell ..... 36/72 B
RE19,543 E * 4/1935 Winget ..... 36/72 B
3,095,659 A * 7/1963 McClellan ..... 36/72 B
3,153,289 A * 10/1964 Martin ..... 36/72 B
3,861,399 A * 1/1975 Huff ..... 36/181
4,441,264 A * 4/1984 Hantz-Guibas et al. ..... 36/72 B
4,660,301 A * 4/1987 Atwood ..... 36/72 B
4,727,659 A * 3/1988 Walker ..... 36/72 B
D301,384 S * 6/1989 Ball ..... D2/915

FOREIGN PATENT DOCUMENTS

GB 2188224 A * 9/1987
GB 2192325 A * 1/1988

* cited by examiner

*Primary Examiner*—Ted Kavanaugh

(57) ABSTRACT

A shoe heel cover is disclosed. An illustrative embodiment of the shoe heel cover includes a resilient cover body having a generally convex back portion, a pair of spaced-apart side portions extending from the back portion and a cover interior defined by the back portion and the side portions. A cushion is provided on the cover body in the cover interior. A method of protecting a heel of a shoe having a shoe body is also disclosed.

2 Claims, 3 Drawing Sheets

SHOE HEEL COVER

FIELD

The present invention relates to shoes. More particularly, the present invention relates to a shoe heel cover which covers and protects the heel of a shoe, particularly during driving.

BACKGROUND

Driving of an automobile requires placement of a driver's foot against an accelerator pedal, with the heel of the driver's shoe resting on the floor of the automobile. Prolonged driving can scratch and scuff the heel of a driver's shoe due to the constant contact of the heel with the automobile floor. Therefore, a shoe heel cover is needed which can be attached to a heel of a shoe to protect the heel from scratches, abrasions and other damage, particularly during driving.

SUMMARY

The present invention is generally directed to a shoe heel cover. An illustrative embodiment of the shoe heel cover includes a resilient cover body having a generally convex back portion, a pair of spaced-apart side portions extending from the back portion and a cover interior defined by the back portion and the side portions. A cushion is provided on the cover body in the cover interior.

The present invention is further generally directed to a method of protecting a heel of a shoe having a shoe body. An illustrative embodiment of the method includes providing a shoe heel cover including a resilient cover body having a generally convex back portion, a pair of spaced-apart side portions extending from the back portion, a cover interior defined by the back portion and the side portions and a cushion provided on the cover body in the cover interior; separating the pair of spaced-apart side portions of the cover body from each other; and recoiling the pair of spaced-apart side portions of the cover body against the shoe body of the shoe.

BRIEF DESCRIPTION OF THE DRAWINGS

The invention will now be described, by way of example, with reference to the accompanying drawings, in which.

DETAILED DESCRIPTION

Figure 1:
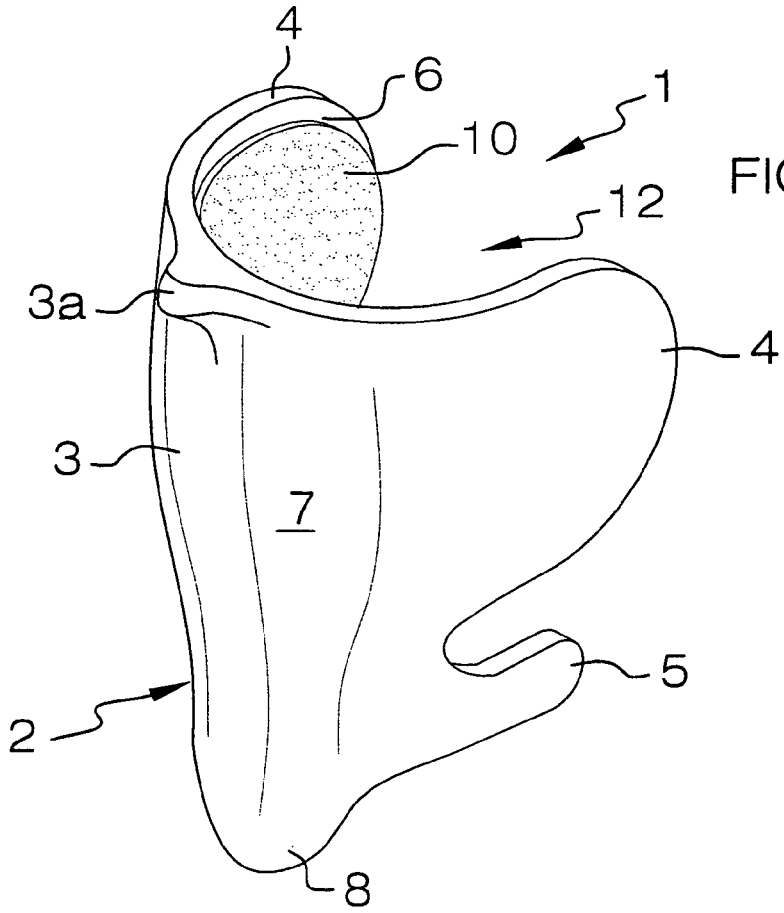
FIG. 1 is a rear perspective view of an illustrative embodiment of the heel cover.
Figure 2:
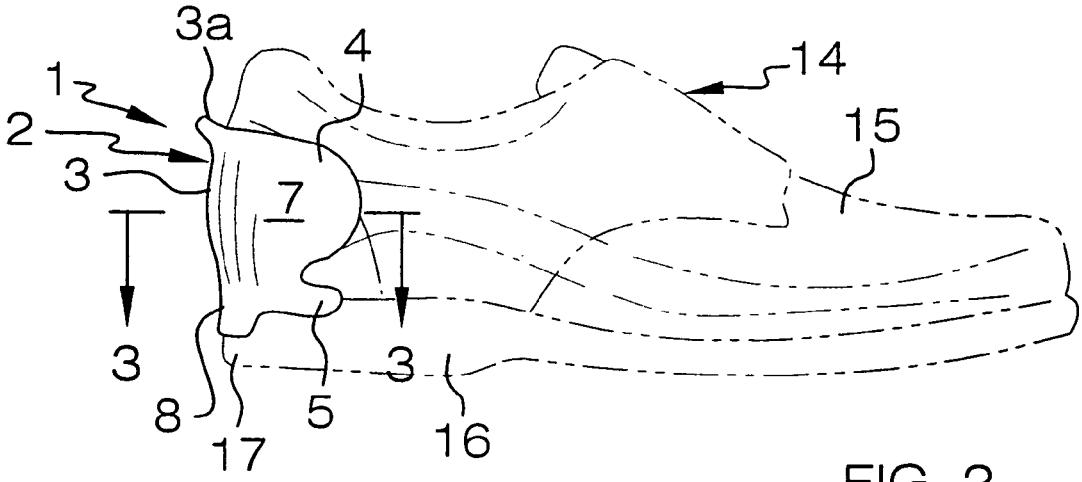
FIG. 2 is a side view of an illustrative embodiment of the heel cover, attached to a heel of a shoe.
Figure 3:
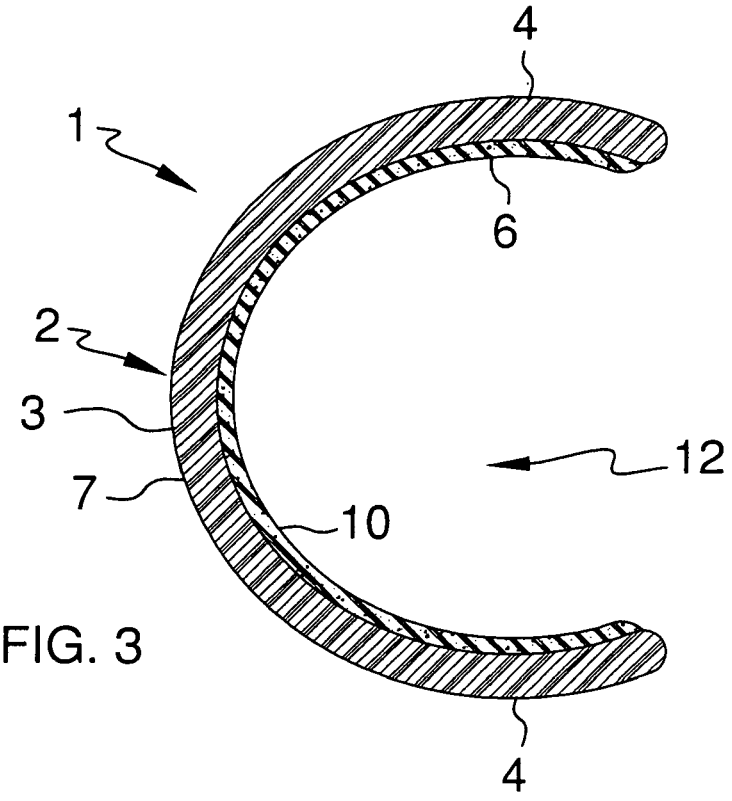
FIG. 3 is a cross-sectional view, taken along section lines 3-3 in FIG. 2.

Referring 1-3, an illustrative embodiment of the shoe heel cover is generally indicated by reference numeral 1. The shoe heel cover 1 is typically resilient plastic and includes a generally elongated cover body 2 having a generally convex back portion 3. As shown in FIGS. 1 and 2, in some embodiments, a lip 3*a* extends from the back portion 3 typically at one end of the cover body 2. A pair of spaced-apart, generally curved side portions 4 extends from the back portion 3. Accordingly, as shown in FIG. 3, the cover body 2 and extending side portions 4 together define a generally C-shaped cross-sectional configuration. A cover interior 12 is defined by the back portion 3 and side portions 4 of the cover body 2. A pair of spaced-apart clip arms 5 extends from the back portion 3 of the cover body 2, adjacent and spaced-apart with respect to the respective side portions 4. In some embodiments, a body extension 8 extends from the back portion 3, typically at the end of the cover body 2 which is opposite the lip 3*a*.

The back portion 3 and side portions 4 of the cover body 2 have an interior surface 6 and an exterior surface 7. A cushion 10 is provided on the interior surface 6. The cushion 10 may be any suitable resilient material including but not limited to rubber or foam rubber.

Referring next to FIG. 2, in typical application, the heel cover 1 is attached to a heel 17 of a shoe 14. The shoe 14 may be a conventional dress shoe, for example, and typically includes a shoe body 15 and a shoe sole 16. The heel cover 1 is particularly adapted to protect flat-heel shoes 14. The heel cover 1 protects the heel 17 of the shoe from scratches, abrasions or other damage particularly during driving as the shoe 14 is worn by a driver (not shown) of an automobile (not shown) and the heel 17 of the shoe 14 rests on a floor 29 (FIG. 5) of an automobile and as the shoe sole 16 is pressed against an accelerator pedal 28 (FIG. 5) in the automobile. The heel cover 1 is attached to the heel 17 of the shoe 14 typically by spreading the side portions 4 and the clip arms 5 of the heel cover 1 apart, placing the heel 17 of the shoe 14 in the cover interior 12 of the heel cover 1 and then allowing the side portions 4 and clip arms 5 to recoil against the sides of the shoe body 15, with the back portion 3 of the cover body 2 extending along the heel 17 of the shoe 14. Therefore, during driving, the shoe heel cover 1 prevents the heel 17 of the shoe 14 from resting on the floor 29 (FIG. 5) of the automobile, thus preventing scratching of the heel 17. The shoe heel cover 1 can be selectively detached from the shoe 14 by disengaging the side portions 4 and clip arms 5 from the shoe body 15. As shown in the upper portion of FIG. 4, the heel cover 1 is also suitable for covering and protecting a heel 21 of a boot 20.

Figure 4:
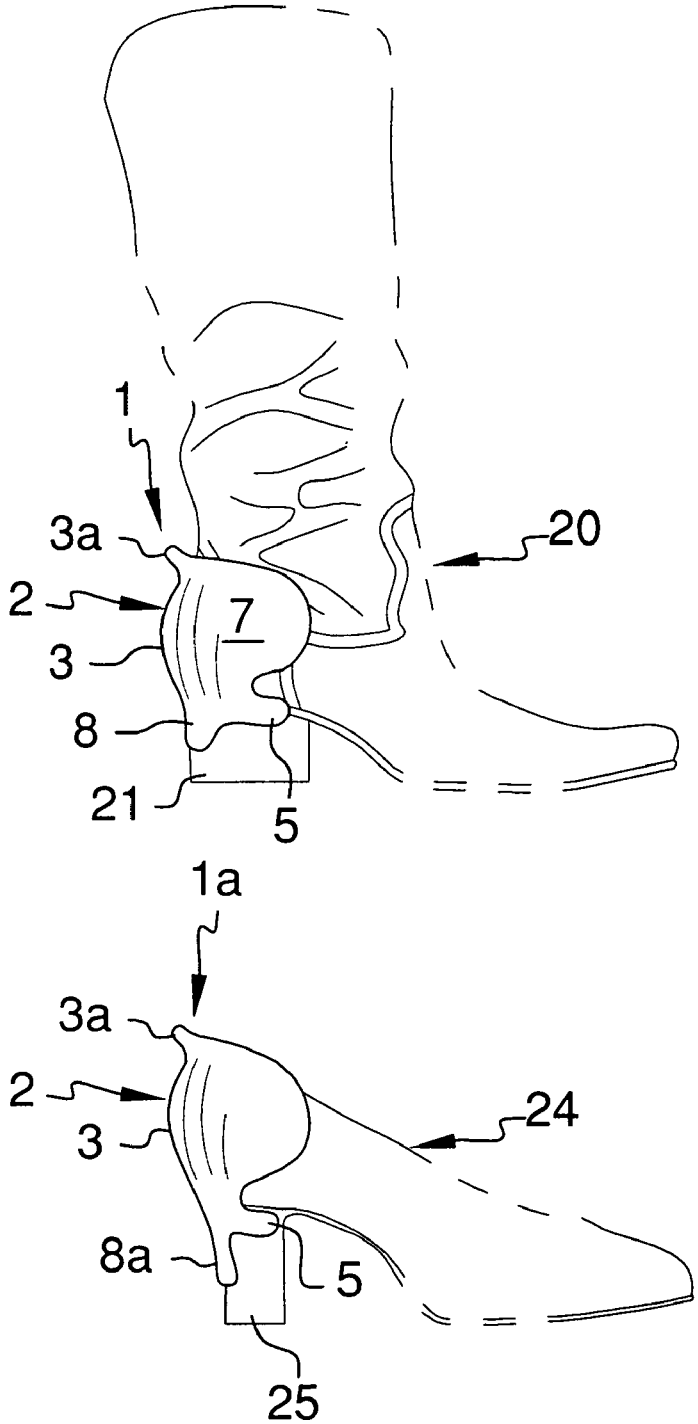
FIG. 4 are side views of a heel cover attached to a heel of a boot and an alternative embodiment of the heel cover attached to a heel of a high-heeled shoe, respectively.

Referring next to the bottom portion of FIG. 4, an alternative illustrative embodiment of the shoe heel cover 1*a* particularly adapted to cover and protect a heel 25 of a high-heeled shoe 24. The shoe heel cover 1*a* is similar in design to the shoe heel cover 1 which was heretofore described with respect to FIGS. 1-3, except the body extension 8*a* of the shoe heel cover 1*a* has an elongated shape. As further shown in FIG. 4, the body extension 8*a* extends along at least a portion of a heel 25 of the high-heeled shoe 24 to partially cover and protect the heel 25 during driving, for example.

Figure 5:
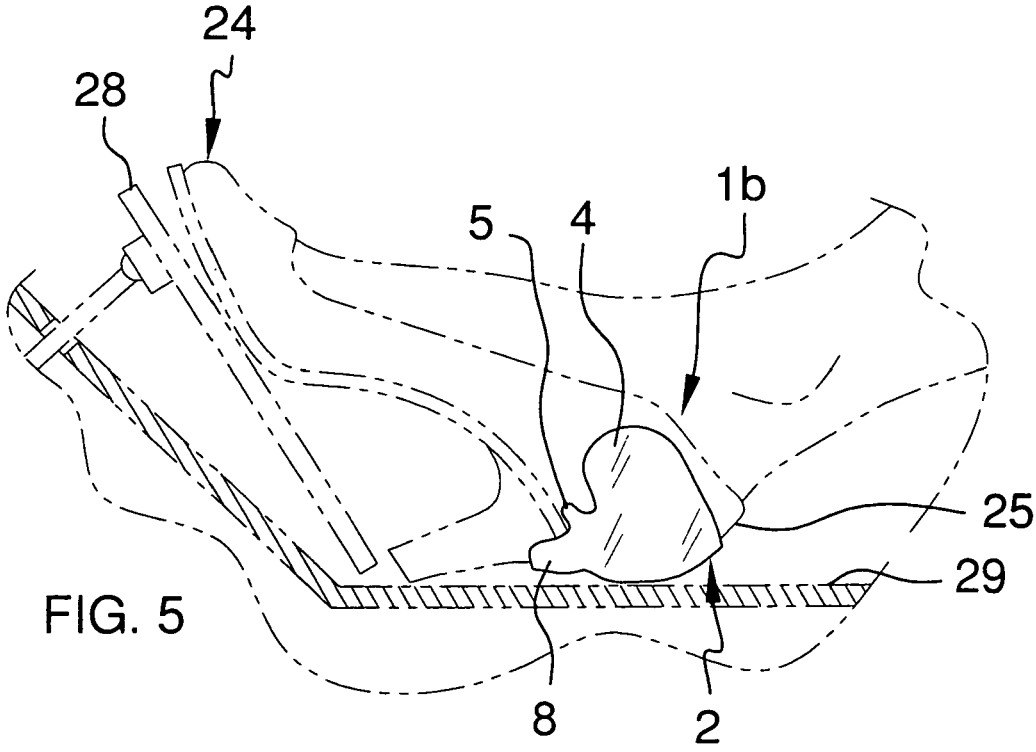
FIG. 5 is a side view of a high-heeled shoe (shown in phantom), with another alternative illustrative embodiment attached to a heel of the shoe and resting on a floor of an automobile as an accelerator (shown in phantom) of the automobile is depressed.

Referring next to FIG. 5, another alternative illustrative embodiment of the shoe heel cover 1*b* is also adapted to cover and protect a heel 25 of a high-heeled shoe 24. The shoe heel cover 1*b* is similar in design to the shoe heel cover 1 in FIGS. 1-3, except the lip 3*a* is omitted from the cover body 2 of the heel cover 1*b*. Therefore, during driving, the shoe heel cover 1*b* prevents the heel 25 of the shoe 14 from resting on the floor 29 of the automobile, thus preventing scratching of the heel 25.

While the preferred embodiments of the invention have been described above, it will be recognized and understood that various modifications can be made in the invention and the appended claims are intended to cover all such modifications which may fall within the spirit and scope of the invention.

What is claimed is:

1. A method of protecting a heel of a shoe having a shoe body, comprising:

providing a shoe heel cover including a resilient cover body having a generally convex back portion, a pair of spaced-apart side portions extending from said back portion, a cover interior defined by said back portion and said side portions and a cushion provided on said cover body in said cover interior;

separating said pair of spaced-apart side portions of said cover body from each other;

recoiling said pair of spaced-apart side portions of said cover body against said shoe body of said shoe; and providing a pair of spaced-apart clip arms extending from said cover body adjacent to said pair of spaced-apart side portions, respectively, and wherein said separating said pair of spaced-apart side portions of said cover body from each other further comprises separating said pair of spaced-apart clip arms from each other and said recoiling said pair of spaced-apart side portions of said cover body against said shoe body of said shoe further comprises recoiling said pair of spaced-apart clip arms against said shoe body of said shoe.

2. The method of claim 1 further comprising a lip extending from said back portion at a first end of said cover body and a body extension extending from said back portion at a second end of said cover body.

* * * * *